United States Patent [19]

Kranz

[11] Patent Number: 4,793,571

[45] Date of Patent: Dec. 27, 1988

[54] MISSILE WITH AERODYNAMIC CONTROL

[75] Inventor: Walter Kranz, Taufkirchen, Fed. Rep. of Germany

[73] Assignee: Messerschmitt-Bölkow-Blohm GmbH, Munich, Fed. Rep. of Germany

[21] Appl. No.: 69,434

[22] Filed: Jul. 2, 1987

[30] Foreign Application Priority Data

Aug. 19, 1986 [DE] Fed. Rep. of Germany ..... 3628152

[51] Int. Cl.[4] ..... F41G 7/00

[52] U.S. Cl. ..... 244/3.1; 244/3.21

[58] Field of Search ..... 244/3.1, 3.21

[56] References Cited

U.S. PATENT DOCUMENTS

| | | | |
|---|---|---|---|
| 2,594,766 | 4/1952 | Goddard | 244/3.1 |
| 3,069,112 | 12/1962 | Patterson | 244/3.19 |
| 3,262,655 | 7/1966 | Gillespie, Jr. | 244/3.1 |
| 4,399,962 | 8/1983 | Wedertz et al. | 244/3.23 |
| 4,579,298 | 4/1986 | Thomson | 244/3.1 |

FOREIGN PATENT DOCUMENTS

| | | | |
|---|---|---|---|
| 3503041 | 9/1986 | Fed. Rep. of Germany | 244/3.21 |

OTHER PUBLICATIONS

Burgdorf et al., "Articulated Nose Missile Configuration", Navy Technical Disclosure Bulletin; vol. 5, No. 8; Aug. 1980.

*Primary Examiner*—Charles T. Jordan

*Attorney, Agent, or Firm*—Kenyon & Kenyon

[57] ABSTRACT

A missile, and in particular a shell flying at supersonic velocity, having aerodynamic control. The missile comprises a missile housing and a missile tip which is tiltably connected to the missile housing. Between the missile housing and the shell tip, a positioning device consisting of at least one piezoelectric positioning member and a control circuit is arranged which comprises a voltage source. By applying a voltage to the piezoelectric positioning members, their lengths are changed, whereby the tilting motion of the shell tip is executed.

9 Claims, 2 Drawing Sheets

MISSILE WITH AERODYNAMIC CONTROL

BACKGROUND OF THE INVENTION

The present invention relates to a missile, particularly a shell flying at supersonic velocity, and having an aerodynamic control system.

In applicant's patent application No. P 35 03 041.0, such a missile is described, the forward part, i.e., the tip of which can be tilted relative to the remaining missile housing at least in one plane by means of a positioning device for fixing the forward part in desired positions relative to the missile housing.

In the aerodynamic control principle used there, the fact is utilized that at high flying speeds, even small asymmetries about a missile transverse axis generate at the missile tip large transverse forces which can be utilized for steering the missile.

It is decisive for such an exact aerodynamic control system that the positioning device is very sensitive and responds in a very short time. In addition, it must have small dimensions so that it can be incorporated also in small-caliber shells.

SUMMARY OF THE INVENTION

It is an object of the present invention to improve the known positioning device further such that large positioning forces with short positioning times are obtained.

The above and other objects of the present invention are achieved by a missile, particularly a shell flying at supersonic velocity, having an aerodynamic control system wherein a forward part of the missile can be tilted relative to the remaining missile housing at least in one plane by means of a positioning device for fixing the forward part into desired positions relative to the missile housing, the positioning device comprising at least one piezoelectric positioning member and electric control means for controlling said positioning member.

Accordingly, a piezoelectric positioning member is employed in the positioning device. Piezoelectric positioning devices are understood to be types in which the piezo effect is utilized for a mechanical length change, such as piezoelectric ceramics, piezoelectric transducers, piezoelectric cells or the like.

Such piezoelectric positioning members develop very large positioning forces with small positioning distance and in addition, have small dimensions so that they also fit well into the shape of a missile tip. The piezoelectric positioning member can act directly without transmission via a lever linkage on the forward part of the missile, whereby inaccuracies in the positioning and fixing of the missile tip are eliminated which otherwise would be caused, for instance, by play of a lever linkage.

The response time of such a positioning member to electric voltages is furthermore very short so that disturbances on the missile during its flight can be compensated rapidly.

It is a further advantage that the surface of the missile need not be interrupted in the vicinity of the tip so that the approximately smooth surface of the shell is preserved. The tip and the remaining missile part can be connected, for instance, by means of an elastic ring or the like, the outer surface of which lies in the surface of the missile.

Piezoelectric positioning members, however, have one disadvantage: as a rule they are extremely temperaturesensitive and therefore exhibit length changes in the case of temperature variations which are no longer negligible as compared to the intended length changes when a voltage is applied. This disadvantage can be eliminated, however, if two identical piezoelectric positioning members are arranged, for instance, in one tilting plane of the missile tip relative to the remaining missile housing. Also, the regular arrangement about the missile longitudinal axis of three or more piezoelectric positioning members corrects this disadvantage perfectly. The piezoelectric positioning members which are preferably aligned parallel to the longitudinal missile axis all are subjected to the same length changes in the case of temperature variations, so that thereby, tilting of the missile tip and thereby steering of the missile becomes impossible.

BRIEF DESCRIPTION OF THE DRAWINGS

The invention will be explained in greater detail in the following detailed description, with reference to the drawings, in which.

DETAILED DESCRIPTION

Figure 1:
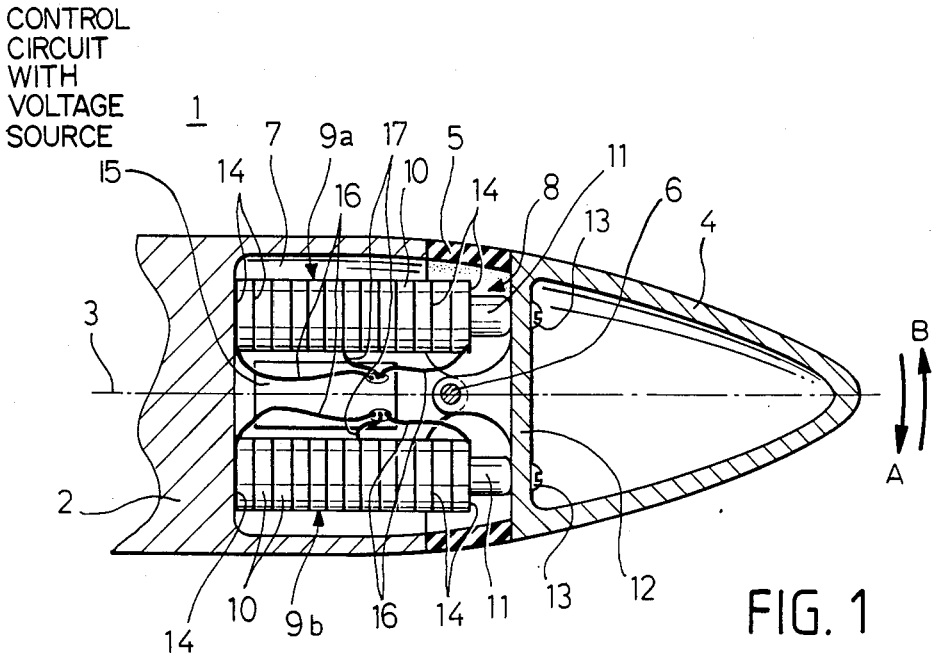
FIG. 1 shows a longitudinal section through the forward part of a shell with a positioning device according to the invention for tilting the missile tip, the positioning device being-arranged in the shell housing.

A shell 1 shown in FIG. 1 has a cylindrical shell housing 2 with a longitudinal axis 3. The forward part of the shell is a shaped shell tip 4 which is connected to the rest of the missile housing 2 via a ring 5 of flexible material which fits into the smooth surface of the shell 1. In addition, the shell tip 4 is braced against the shell housing 2 via a pivot bearing 6 located on the longitudinal axis 3.

Following the shell tip 4, the shell housing 2 has a recess 7 in which a positioning device 8 is arranged. This positioning device comprises two piezoelectric positioning members 9*a*, 9*b* which are constructed as columns from a multiplicity of piezoelectric discs 10, for instance, of ceramic material. The positioning members 9*a* and 9*b* are aligned parallel of the longitudinal axis 3 and are arranged symetrically thereto. They are braced with their one end against the bottom of the recess 7 and carry at the other end a plunger 11 each which rests against a back wall of the shell tip 4. The plungers 11 may be connected to the rear wall 12 via screws 13 guided in elongated holes. The two positioning members 9*a* and 9*b* are electrically insulated from the shell housing 2 as well as from the back wall 12. On both sides of the column-shaped positioning members 9*a*, 9*b* and between the individual piezoelectric discs 10, electrodes 14 are arranged; the columns themselves may optionally be pretensioned.

In the recess 7 of the shell, a control circuit 15 with a voltage source is located between the piezoelectric positioning members 9*a* and 9*b*. Lead wires 16 go at least to the two electrodes 14 on the front and back sides of the two positioning members 9*a* and 9*b*. Branch lines to intermediate electrodes may likewise be provided.

If a voltage is applied between the electrodes 14 on the front and back side of the upper piezoelectric positioning member 9a via the control circuit 15 in the rest position of the missile tip shown in FIG. 1, this piezoelectric positioning member expands in the longitudinal direction of the column, thereby the shell tip 4 is rotated in the direction of the arrow A. The longitudinal expansion of the piezoelectric positioning member depends on the applied voltage. The positioning force is very large here, so that the opposite piezoelectric positioning member 9b is compressed. Separate actuation of this second piezoelectric positioning member 9b is not necessary as a rule. However, it is also possible to subject this second piezoelectric positioning member to a voltage of opposite polarity, so that it contracts and does not interfere with the tilting of the shell tip 4 in the direction of the arrow A.

In order to obtain different longitudinal expansions, either the voltage between the electrodes 14 can be changed, or the voltage is applied between tee electrode facing the back wall 12 and an intermediate electrode via a branch line 17.

The shell tip 4 is reset by taking off the voltage for the upper piezoelectric positioning member 9a. By the elasticity of the ring 5 the shell tip is then tilted back. This motion can be aided if voltage is applied to the lower piezoelectric positioning member 9b. In addition, the pivot bearing 6 of the shell tip can further be spring-supported, the spring then always acting in the direction toward the rest position.

If the shell tip 4 is to be tilted in the other direction according to the arrow B, the lower piezoelectric positioning member is actuated accordingly.

Figure 2:
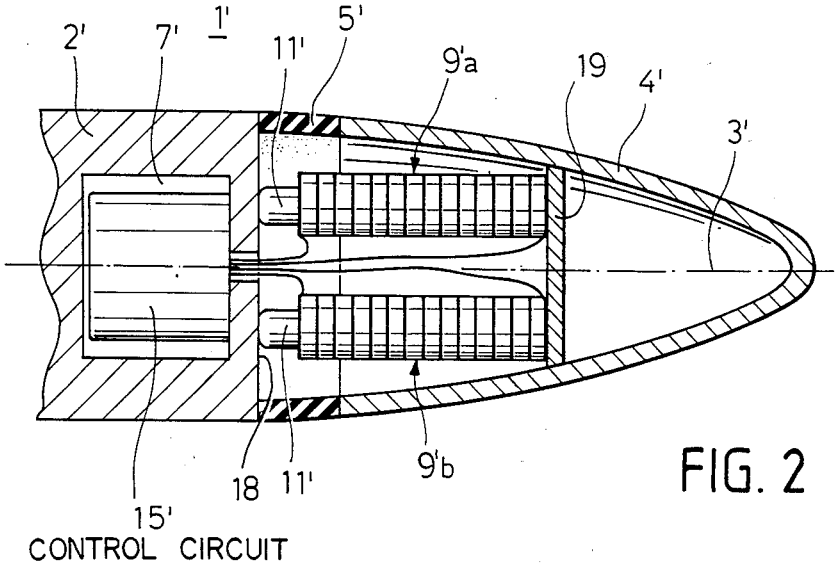
FIG. 2 shows a longitudinal section through another embodiment of the invention, the positioning device being arranged in the tip of the shell.

In FIG. 2, the forward part of a shell 1' with a shell housing 2' which are connected to each other via an elastic ring 5. Two piezoelectric positioning members 9'a and 9'b are supported in the shell tip on opposite sides of the longitudinal axis 3' and are braced on a terminating wall 18 of the shell housing 2' with a plunger 11'. The back sides of the piezoelectric positioning member 9'a and 9'b rest against a wall 19 within the shell tip 4.

The construction of the piezoelectric positioning members 9'a, 9'b is identical with that of the positioning members 9a and 9b in FIG. 1.

A control circuit 15' corresponding to that shown in FIG. 1 is arranged in a recess 7' of the shell housing 2', via which the piezoelectric positioning members 9'a and 9'b can be addressed in the same manner as was described above. The contact surface of the plungers 11' can be rounded like the plungers 11 shown in FIG. 1 in order to avoid unnecessary shear forces when the shell tip 4' is tilted.

Figure 3:
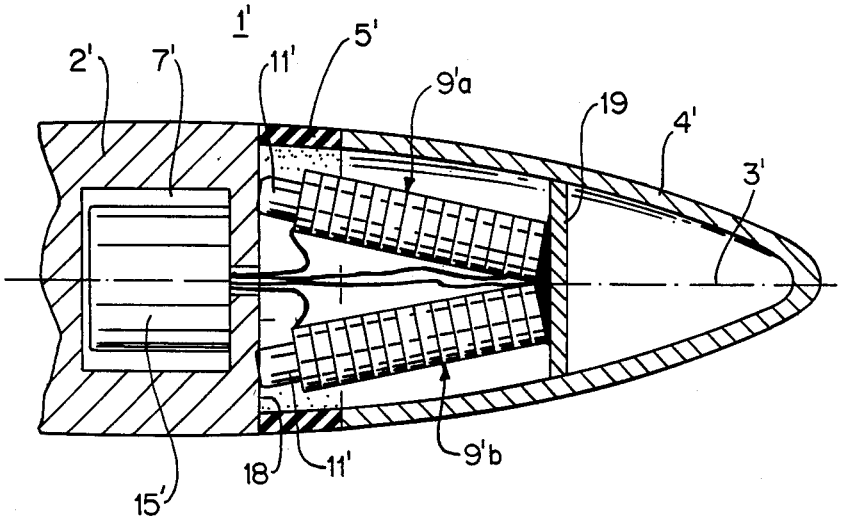
FIG. 3 shows a longitudinal section through another embodiment of the invention, the positioning device being arranged in the tip of the shell and inclined relative to the longitudinal axis of shell.

With both embodiments it is possible that the piezoelectric positioning members are inclined relative to the longitudinal axis of the shell and are not arranged parallel as shown. This is illustrated in FIG. 3, wherein the reference numbers in FIG. 2 refer to the same parts in FIG. 3. The operating principle is not changed thereby. It is furthermore not absolutely necessary to connect the shell housing and the shell tip by means of a ring of elastic material. This connection only must make possible a tilting of the shell tip relative to the shell housing, independently of the design. The described embodiments with two piezoelectric positioning members can, of course, be replaced by several positioning members in several planes or by a regular arrangement of positioning members about the longitudinal axis of the shell, so that a control of the missile in several planes is possible.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A missile, particularly a shell flying at supersonic velocity, having a missile housing and an aerodynamic control system wherein a forward part of the missile can be tilted relative to the missile housing at least in one plane by means of a positioning device for fixing the part into desired positions relative to the missile housing, the positioning device comprising at least one piezoelectric positioning member and electric control means for controlling said positioning member.

2. The missile recited in claim 1, wherein the piezoelectric positioning member comprises a column of a plurality of piezoelectric discs separated by electrodes.

3. The missile recited in claim 2, wherein the control means is electrically connected to different electrodes of the piezoelectric positioning member.

4. The missile recited in claim 1, wherein the piezoelectric positioning member is arranged in a recess in the missile housing and is braced against a back wall of the forward part of the missile.

5. The missile recited in claim 1, wherein the piezoelectric positioning member is arranged in the forward part of the missile and is braced against a terminating wall of the missile housing.

6. The missile recited in claim 1, wherein, for each tilting plane of the forward part of the missile, two piezoelectric positioning members are provided symmetrically on opposite sides of the longitudinal axis of the missile.

7. The missile recited in claim 1, wherein a plurality of piezoelectric positioning members are provided in a regular arrangement about the longitudinal axis of the missile.

8. The missile recited in claim 1, wherein the piezoelectric positioning members are aligned parallel to the longitudinal axis of the missile.

9. The missile recited in claim 1, wherein the piezoelectric positioning member is arranged inclined relative to the longitudinal axis of the missile.

* * * * *